US008601774B2

(12) United States Patent
Beuther

(10) Patent No.: US 8,601,774 B2
(45) Date of Patent: Dec. 10, 2013

(54) FACIAL TISSUE PRODUCT WITH A CLIP RISER

(75) Inventor: Paul Douglas Beuther, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 13/530,560

(22) Filed: Jun. 22, 2012

(65) Prior Publication Data

US 2012/0261055 A1 Oct. 18, 2012

Related U.S. Application Data

(62) Division of application No. 12/647,741, filed on Dec. 28, 2009, now Pat. No. 8,220,659.

(60) Provisional application No. 61/160,450, filed on Mar. 16, 2009.

(51) Int. Cl.
*B65B 27/08* (2006.01)

(52) U.S. Cl.
USPC ..... 53/429; 53/117; 53/566; 156/84; 221/36; 221/59

(58) Field of Classification Search
USPC ..... 53/429, 117, 474, 566; 221/36, 58, 59, 221/63; 156/84, 85
See application file for complete search history.

(56) References Cited

U.S. PATENT DOCUMENTS

| | | | | |
|---|---|---|---|---|
| 3,942,682 | A | 3/1976 | McKay | |
| 4,114,236 | A | 9/1978 | Vandervort | |
| 4,586,631 | A * | 5/1986 | Loder | 221/58 |
| 4,842,136 | A | 6/1989 | Nakazato et al. | |
| 5,335,826 | A | 8/1994 | Kazino | |
| 5,363,985 | A | 11/1994 | Cornell | |
| 5,979,700 | A | 11/1999 | Suess | |
| 5,992,683 | A * | 11/1999 | Sigl | 221/59 |
| 6,068,583 | A * | 5/2000 | Sigl | 493/60 |
| 6,349,525 | B1 * | 2/2002 | Veith | 53/429 |
| 6,749,084 | B2 | 6/2004 | Thompson | |
| 8,044,502 | B2 | 10/2011 | Rathburn | |
| 2006/0060599 | A1 | 3/2006 | Zychinski | |

FOREIGN PATENT DOCUMENTS

| | | | |
|---|---|---|---|
| JP | 06-080174 | A | 3/1994 |
| JP | 2000-116566 | A | 4/2000 |
| JP | 2002-223981 | A | 8/2002 |
| KR | 20-0342743 | Y1 | 11/2003 |

* cited by examiner

*Primary Examiner* — Thanh Truong
(74) *Attorney, Agent, or Firm* — Kimberly-Clark Worldwide, Inc.

(57) ABSTRACT

A tissue product, which includes a carton and a stack of tissues, is provided with a flattened arched-shaped sheet that supports the stack of tissues. As the tissues are withdrawn from the carton and the weight of the tissue stack is reduced, the flattened arch-shaped sheet gradually assumes its normal arched shape, thereby raising the stack of tissues within the carton. Raising the stack substantially reduces or eliminates "fall-back", which is a common dispensing problem, as the stack height is reduced.

8 Claims, 7 Drawing Sheets

FACIAL TISSUE PRODUCT WITH A CLIP RISER

This application is a divisional of U.S. application Ser. No. 12/647,741 entitled "Facial Tissue Product with a Clip Riser" filed on Dec. 28, 2009, which claims priority from U.S. Provisional Application No. 61/160,450 entitled "Facial Tissue Product with a Clip Riser" filed on Mar. 16, 2009.

BACKGROUND OF THE INVENTION

Facial tissues are available in many different forms. One common facial tissue product is sometimes referred to as a family size product, which comprises a rectangular carton measuring about 9 inches long and about 4 inches high and contains a stack (also referred to as a "clip") of about 250-300 interfolded tissues. The user withdraws the tissues through an opening in the top of the carton. As a tissue is withdrawn, the interfolding causes the next tissue to be partially withdrawn, which is often referred to as "pop-up" dispensing. A common complaint with such products is that as the tissues are depleted and the stack of remaining tissues within the carton is reduced in height, the distance between the top of the stack and the dispensing opening becomes greater. At some point, the pop-up dispensing feature fails, requiring the user to reach down into the carton to grasp the next available tissue from the top of the stack. Sometimes the pop-up feature can be reestablished, but often it continues to fail after the number of remaining tissues reaches a certain level.

Therefore there is a need for a means for improving the reliability of pop-up dispensing in flat tissue cartons containing a large number of tissues.

SUMMARY OF THE INVENTION

It has now been discovered that fall-back in certain tissue products can be greatly reduced or eliminated by providing a flattened clip riser positioned under the clip of tissues within the carton. In an unstressed state, the clip riser has an arched shape and a memory, such that as the tissues are removed from the carton and the weight of the remaining clip is reduced, the clip riser seeks to return to its normal arched shape and thereby urges the remaining clip upwardly toward the dispensing opening.

Hence in one aspect, the invention resides in a tissue product comprising a carton with a dispensing opening and a stack of tissues to be withdrawn through the dispensing opening, said stack of tissues in contact with a flattened arched-shaped clip riser sheet, wherein as the tissues are withdrawn from the carton, the flattened arch-shaped clip riser sheet gradually bends, thereby urging the stack of tissues within the carton toward the dispensing opening. In a particularly suitable embodiment, the stack of tissues rests on top of and is supported by the arch-shaped clip riser sheet, such that the clip of tissues is lifted vertically within the carton toward a dispensing opening in the top of the carton. However, in another embodiment, the dispensing opening can be in a sidewall of the carton, such that the arch-shaped clip riser sheet moves or urges the clip sideways as space within the carton is created by withdrawal of the sheets. As used herein, the term "tissue" is broadly used to include relatively high bulk (3 or more cubic centimeters per gram) cellulosic sheets, particularly including facial tissues, bath tissues, paper towels and table napkins.

The arch-shaped clip riser sheet can be formed and incorporated into a tissue carton by any number of ways, provided the arch-shaped clip riser sheet has sufficient memory to assume an arched shape when not under a load. For example, a heat-shrinkable sheet can be laminated to a non-heat shrinkable sheet or a sheet that shrinks to a lesser degree using a suitable adhesive while in a flat or relatively flat condition. Thereafter, the laminate can be heated, causing the laminate to form an arch due to the differential in the heat shrinkage characteristics of the materials. Alternatively, the arch-shaped clip riser sheet can be initially formed by laminating two sheets of material together while the two sheets are maintained in an arched shape. The lamination can be accomplished using adhesive, such as hot melt adhesives. Alternatively, an arched-shaped clip riser sheet can be made from a single- or multi-layered sheet of plastic material that is formed into an arch, heated to relax stresses while maintained in the arched shape, and then cooled to set the arched shape. In all cases, the arch-shaped clip riser sheet is inserted into the tissue carton in a flat (stressed) state, so that as sheets are removed from the carton, the stresses in the arch-shaped clip riser sheet are reduced as the arch-shaped clip riser sheet bends and seeks to reach an unstressed or fully arched state.

Hence in another aspect, the invention resides in a method of making a tissue product comprising: (a) continuously combining a bi-component sheet material with the underside of a moving continuous clip of interfolded tissues, said bi-component sheet material having a top layer and a bottom layer, wherein the top layer is in contact with the underside of the continuous clip of tissues; (b) cutting the continuous clip of tissues and the bi-component sheet material into individual clips, wherein the resulting individual clips of tissues are supported by a bi-component sheet; (c) heating or otherwise causing the bottom layer of the bi-component sheet to shrink and create an arch-shaped clip riser sheet, wherein the weight of the clip of tissues substantially prevents the arch-shaped clip riser sheet from arching; and (d) inserting the clip of tissues, supported by the arch-shaped clip riser sheet, into a tissue carton.

In another aspect, the invention resides in a method of making a tissue product comprising:

(a) continuously combining a bi-component sheet material with the underside of a moving continuous clip of interfolded tissues, said bi-component sheet material having a top layer and a bottom layer, wherein the top layer is in contact with the underside of the continuous clip of tissues;

(b) cutting the continuous clip of tissues and the bi-component sheet material into individual clips, wherein the resulting individual clips of tissues are supported by a bi-component sheet;

(c) inserting the clip of tissues, supported by the bi-component sheet, into a tissue carton; and (d) heating or otherwise causing the bottom layer of the bi-component sheet to shrink and create an arch-shaped clip riser sheet, wherein the weight of the clip of tissues substantially prevents the arch-shaped clip riser sheet from arching.

In another aspect, the invention resides in a method of making a tissue product comprising: (a) continuously combining a flattened laminated sheet material with the underside of a moving continuous clip of interfolded tissues, said laminated sheet material having been formed by adhering two or more layers of sheet material together while at least partially wrapped around an arched surface, such as a roll, to impart an arched-shape memory to the laminated sheet material; (b) cutting the continuous clip of tissues and the flattened laminated sheet material into individual clips, wherein the resulting individual clips of tissues are supported by a flattened arch-shaped clip riser sheet, wherein the weight of the clip of tissues substantially prevents the arch-shaped clip riser sheet from arching; and (c) inserting the clip of tissues, supported by the arch-shaped clip riser sheet, into a tissue carton.

In another aspect, the invention resides in a method of making a tissue product comprising: (a) continuously combining a flattened sheet material with the underside of a moving continuous clip of interfolded tissues, said sheet material having been (i) bent over an arched surface, such as a roll; (ii) heated to relax stresses created by the bending; and (iii) cooled to impart an arched-shape memory to the sheet; (b) cutting the continuous clip of tissues and the flattened sheet material into individual clips, wherein the resulting individual clips of tissues are supported by a flattened arch-shaped clip riser sheet, wherein the weight of the clip of tissues substantially prevents the arch-shaped clip riser sheet from arching; and (c) inserting the clip of tissues, supported by the arch-shaped clip riser sheet, into a tissue carton.

Advantageously, as previously discussed, the arch-shaped clip riser sheet material can be a bi-component sheet comprising at least two different materials arranged in a layered configuration and which have differing shrinkage characteristics when heated or otherwise "activated" to relieve stress. This uneven shrinkage causes the sheet to bend or arch. In use, the bottom component can be selected to shrink more than the top component to create the arched shape suitable to raise the clip of tissues. The amount of bending in the sheet is a balance of forces between the stresses in the top and bottom components and the weight of the tissue clip. More particularly, it is influenced by the material of the top component, the material of the bottom component, the thicknesses of the two components, and the modulus of the materials. While two components are sufficient for most purposes, clip riser sheets having three or more components can be used. For purposes herein, a "bi-component clip riser sheet" is a sheet having two or more components or layers.

Suitable materials for the top component of the bi-component clip riser sheet include, without limitation, paper, paper board, plastic or metal. Suitable materials for the bottom component of the bi-component clip riser sheet include, without limitation, plastic films, plastic sheeting and metal. While completely different materials can be used for the top and bottom components, it is suitable to use the same material for both components, provided the shrinkage characteristics of the material in both components is different. For example, plastic films and sheets of the same material are commonly made with different levels of stress, so the generically same plastic sheet material, such as polypropylene, can be designed to be used in both layers or components. Paper materials, however, are particularly useful for the top component (the component contacting the clip of tissues) because they are convenient, relatively inexpensive and do not shrink when heated, thus providing ideal top component characteristics. A consideration when selecting the components of the sheet is that the clip riser needs to retain its arched-shape memory sufficiently long to perform its intended function. Some materials may begin to sag too soon after being inserted into the product container if the arch-shaped clip riser sheet is under-designed.

Suitable means for bonding the layered components together include adhesives, such as hot melt adhesives. The adhesive should have a cure time sufficiently short so that it sets before the laminated material is shrunk or, if the laminate is formed on an arched surface, before the laminate is removed from the arched surface. It is preferred that such adhesives have a low creep in order not to change shape over time. Also, it is desirable that the adhesives are able to withstand temperatures higher than that used to shrink the plastic component of the sheet. Other suitable means for adhering the layered components together include heat or ultrasonic bonding in a fixed pattern, such as is common for nonwoven materials, or mechanical bonding, such as embossing, stitching, and the like.

The height of the arch of the unstressed arch-shaped clip riser sheet can be about 1 inch or more, more specifically from about 1 to about 6 inches, more specifically from about 1 to about 4 inches, more specifically from about 1 to about 3 inches, and still more specifically from about 2 to about 3 inches. These ranges are suitable for most commercially available tissue products. It will be appreciated that the height of the arch of the unstressed arch-shaped clip riser sheet can be greater than the height of the carton since, in use, the top of the carton will prevent the arch-shaped clip riser sheet from expanding further.

The thickness of the component layers of the clip riser sheet can be, without limitation, from about 0.1 to about 3 millimeters, more specifically from about 0.25 to about 2 millimeters and still more specifically from about 0.5 to about 1.25 millimeters.

In order for the clip riser sheet to function properly, the length of the clip riser sheet must be larger than the desired height for it rise. Suitable lengths can be from about 6 to about 12 inches, more specifically from about 7 to about 10 inches, and still more specifically from about 8 to about 9 inches. Aside from cost considerations, a length which is equal to the length of the tissue clip is particularly suitable.

The width of the clip riser sheet can be any width that is sufficient to provide enough strength or stiffness to the sheet to raise the clip the desired height. Wider sheets will provide greater lifting capacity. For purposes herein, the width of the clip riser sheet can be, without limitation, from about 1 to about 4 inches. A width of about the width of the tissue clip is particularly suitable since that provides maximum lifting capacity for the chosen clip riser sheet, as well as providing a stable platform for the tissue clip.

The amount of heating or other activation necessary to trigger shrinkage of the bi-component clip riser sheet depends on the materials being used. Because paper and plastic materials are very dependent on their manufacturing processing, it is difficult to broadly characterize how much heat, for example, is needed. However, the requirements can be quantified based on specific properties.

DETAILED DESCRIPTION OF THE DRAWINGS

Figure 1A:
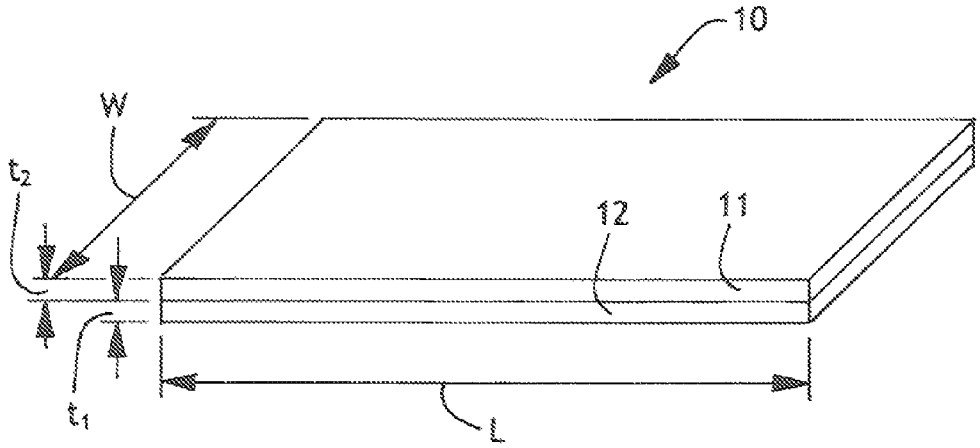
FIG. 1A is a schematic perspective view of a bi-component sheet useful for forming, upon activation, an arch-shaped clip riser sheet in accordance with this invention, illustrating the various dimensions of the sheet.
Figure 1B:
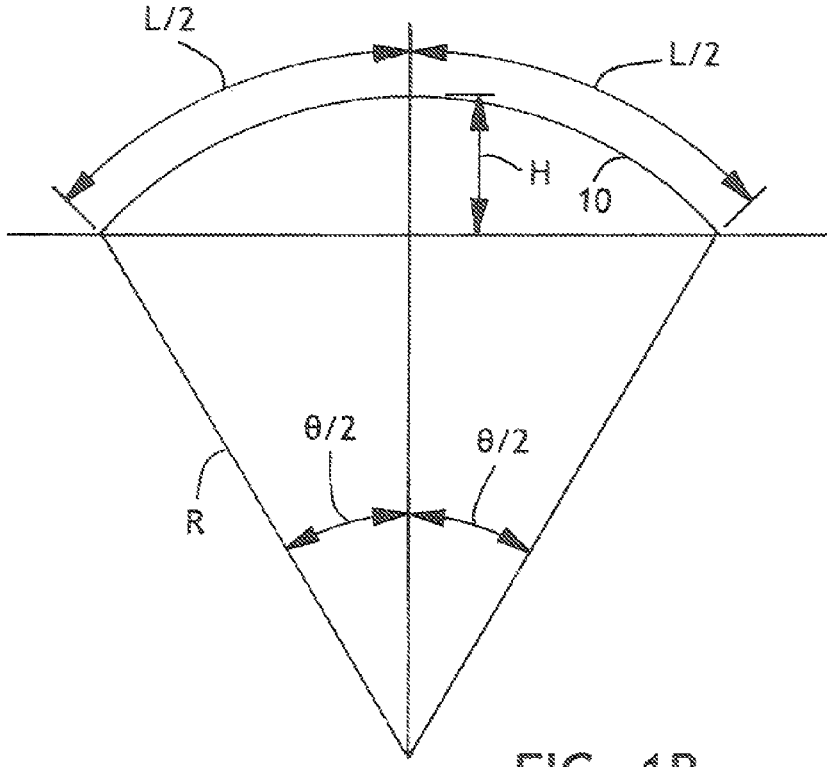
FIG. 1B is a schematic illustration of the bending of the sheet, illustrating some additional dimensions of the sheet discussed herein.

FIGS. 1A and 1B provide a basis for a discussion of the mechanics associated with the clip riser sheets of this invention. Referring first to FIG. 1A, shown is a bi-component sheet 10 which can serve as the arch-shaped clip riser of this invention upon being heat-activated. The bi-component sheet comprises a top layer 11, which can be paper or paper board, for example, and a bottom layer 12, which can be plastic, for example. The sheet has a length "L", a width "W". The bottom layer (the layer that shrinks) has a thickness "$t_1$" and the top layer (the layer that expands) has a thickness "$t_2$". The two layers are bonded together, such as by any suitable adhesive, in order to prevent the two layers from shrinking independently of each other when subjected to heat, microwaves or other activation. While specific materials used for each layer can be selected from a wide variety of materials, all that is required is that the bi-component sheet bend or arch when the sheet is activated due to the differing tendencies of each layer to shrink.

FIG. 1B illustrates the bending geometry of the activated clip riser sheet for purposes of discussion below. The maximum distance the activated clip riser bends (with no load) is designated as "H". "θ" is the angle between the opposite ends of the bent sheet. The radius of curvature of the activated clip riser with no load (without supporting a full tissue clip) is "R", which equals $L^2/(8*H)$. This value for "R" is an approximation for small values of "H", but it is accurate to within 10% for typical values for "H" and "R". A more precise relationship is given by the equation:

$$H=R-R*\mathrm{Cos}(L/2R).$$

This equation is difficult to invert to obtain "R" as a function of "H", but it is trivial to determine "R" through trial and error once "H" and "L" are specified. From geometry, the strain due to the length change is related to the thickness and the radius of curvature as follows:

$$\%\ \mathrm{strain}=100\%*(t_1+t_2)/(2*R).$$

Substituting the approximate equation for "R" and solving for "H", the result is:

$$\%\ \mathrm{strain}=100\%*4*H*(t_1+t_2)/L^2,\ \text{or}$$

$$H=(\%\ \mathrm{strain}/100\%)*L^2/(4*(t_1+t_2))$$

This is a key parameter for estimating the required strain for a given desired height. The relationship assumes that the modulus of the two materials is similar. If this is not the case, a more detailed analysis can be done that relates the strain to the two moduli, $E_1$ and $E_2$. It shows that if the material properties are different, a larger strain is needed. Similar results can be shown for different thicknesses.

$$H=6*\mathrm{strain}*E_1*E_2*L^2/(t_1*(E_1^2+E_2^2+14*E_1E_2))$$

None of these equations predicts whether or not the clip riser is strong enough to lift the stack of tissues, but they help determine the required shrinkage or expansion properties of the materials. Focusing just on shrinkage of the bottom layer, the material needs to shrink a defined amount that is easily estimated. It is straightforward to find one of many materials that will shrink that amount at a given temperature. Similarly, if a material shrinks more than that it is straightforward to determine from a material property sheet what temperature is needed to cause the desired shrinkage. For a typical clip riser, the % strain will be about 1%.

Not only is it important for the clip riser to support the last tissue sheet at the desired height "H", it is also important that the clip riser be substantially flat when the weight of the full tissue clip is on it. This is to avoid impairing withdrawal of the first (top) sheet from the carton by compressing the first sheet against the top of the carton. The clip riser could be designed for any arbitrary height for full load, but the focus here is for a fully flattened clip riser when under a full clip of tissues. This is more complicated due to the large deformation of the clip riser, so the calculations offered here are again approximate, but sufficient to design a clip riser that is close to the desired properties. Simple experimentation will allow one to modify the parameters slightly to optimize the performance. One can also conduct a finite element analysis for large deformation to better predict performance. The width of the clip riser can also be narrowed (or widened) if less (or more) lift capacity is needed.

If both materials are of similar thickness and similar modulus, the deflection of a uniformly loaded beam follows a well-known formula:

$$E*I*y(x)=x^3*\mathrm{weight}*L/12-x^4*\mathrm{weight}/24*-x*\mathrm{weight}*L^3/24$$

where "y" is the deflection at any distance "x" along the clip riser;
"weight" is the weight per unit length;
"L" is the length;
"E" is the modulus; and
"I" is the moment of inertia of the cross-section of the clip riser.

For a uniform thickness "t", the moment of inertia is given by:

$$I=1/12\,\mathrm{width}*t^3.$$

Re arranging to solve for the modulus as a function of width, length, thickness and maximum height yields:

$$E=5/32*\mathrm{weight}*L^4/(H*\mathrm{width}*t^3)$$

where"E" is the material modulus;
"weight" is the weight of the tissue clip per unit length;
"L" is the length of the clip riser;
"H" is the desired maximum height to be raised;
"width" is the width of the clip riser; and
"t" is the total thickness.

Conversely, one can reorder the terms to solve for the desired thickness of the material, given the modulus, but changing the thickness will affect the maximum height of the riser, so this is an iterative process. The force can also be adjusted by changing any of the other parameters, such as the width. A more precise solution can be obtained incorporating the different thicknesses and moduli of the two materials, along with taking into account the effects of large deformations which will be slightly larger than the small deformation assumption above. Those skilled in the art will appreciate that these calculations can be found in most reference books which discuss the strengths of materials, but are too detailed to include here. By way of example, see Schaum's Outline series for Strength of Materials, 2nd edition, ©1972, pp 155-177, which is hereby incorporated by reference.

By way of example, a bi-component arch-shaped clip riser sheet was prepared having a length of about 9 inches and a width of about 4 inches, which is a size suitable to fit into most flat tissue cartons. The top layer component was a paper board material taken from a standard manila file folder (SMEAD Corp item number 2-152-5LA), having a thickness of about ½ millimeter. The bottom layer component was a polyvinyl chloride/polyvinyl acetate plastic film, commonly used for report covers (OXFORD Standard Grade Clear Front Report Cover, item number 55856, Esselte Corp (Pendaflex.com), also having a thickness of about ½ millimeter. The two components were glued together using Elmers Stix All glue by applying several smears of glue oriented mainly in the long direction. Upon activation by heating, using a heat gun to blow on the plastic component, the plastic film layer shrunk about 1 percent in the lengthwise direction of the sheet, while the paper board material had no tendency to shrink. The result was an arched-shaped clip riser which bent about 2 inches in the vertical direction, which is believed to be a suitable amount of bending to sufficiently elevate the tissue clips of most tissue cartons. Other examples were made by baking the bicomponent sheet in an oven at 80-90 degrees C. for 60 seconds, although this method sometimes required manual bending of the finished clip riser after removal from the oven because the plastic became too soft to provide the necessary force to curl the cardboard.

Figure 2:
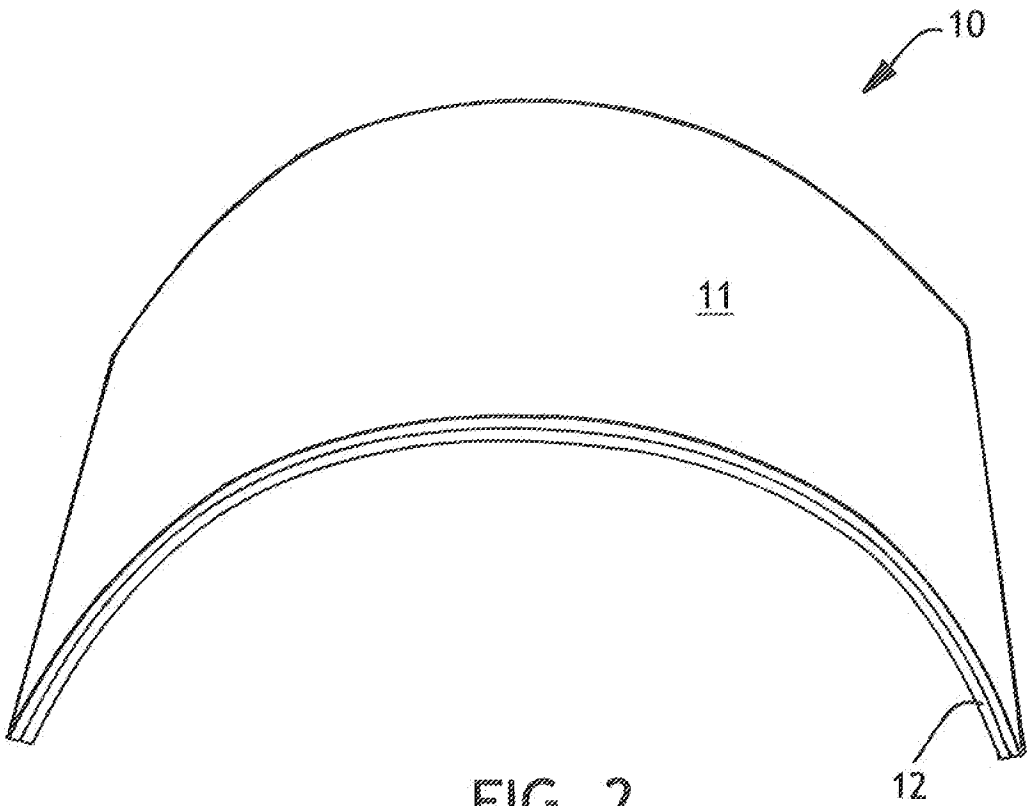
FIG. 2 is a schematic perspective view of the arch-shaped clip riser created from the bi-component sheet of FIG. 1A.

FIG. 2 illustrates the clip riser sheet of FIG. 1 in an arched configuration after the application of energy to create shrinkage of the plastic film component. While shrinkage in the lengthwise direction of the sheet only is particularly suitable, bi-directional shrinkage of the sheet is also acceptable, but will create more of a dome-shaped clip riser. Materials, such as plastic films, that preferentially shrink in one direction can be created by processing them with added strain in one direction. This is a common property of many plastics due to normal processing.

Figure 3:
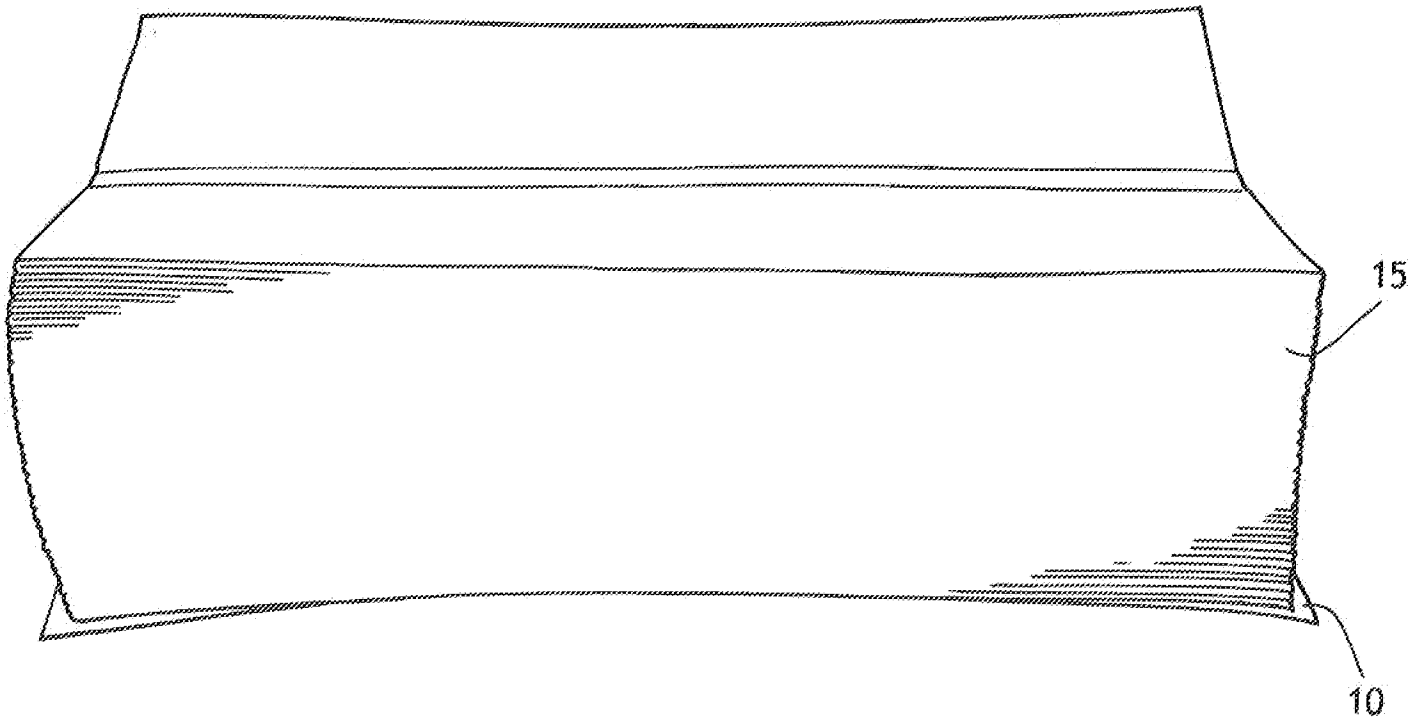
FIG. 3 is a drawing replicating a photograph of a full clip of facial tissues resting on the arch-shaped clip riser of FIG. 2, illustrating how the arch-shaped clip riser is flattened under the weight of a full clip of facial tissues.

FIG. 3 is a drawing replicating a photograph taken of an actual example of the invention. Shown is the arch-shaped clip riser sheet 10 of FIG. 2 with a full clip of tissues 15 resting on top of the sheet as would be the situation inside a full carton of tissues. The number of tissue sheets in the clip was about 120. The weight of the clip was 150 grams. As shown, the arch-shaped clip riser sheet was substantially flattened.

Figure 4:
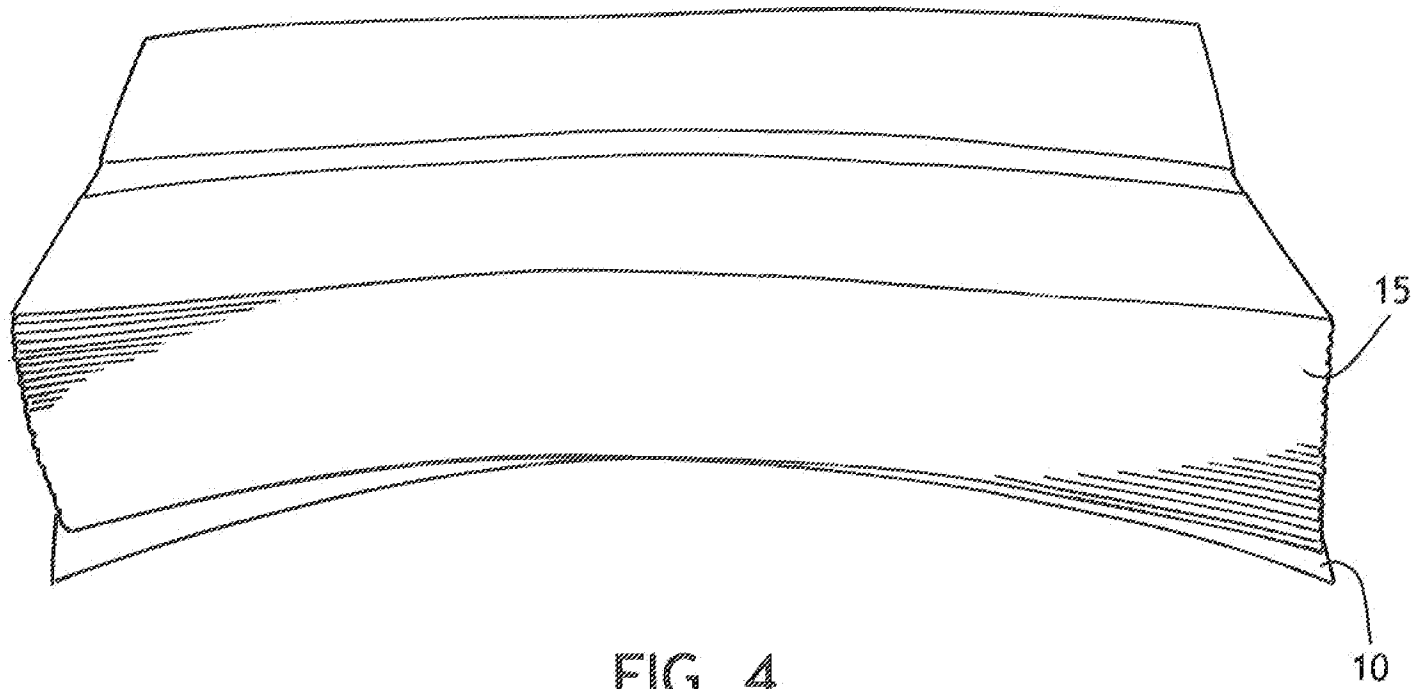
FIG. 4 is a drawing replicating a photograph of a partial clip of facial tissues resting on the arch-shaped clip riser of FIG. 2, illustrating how the arch-shaped clip riser begins to assume its normal shape as the weight of the clip of tissues is reduced, thereby raising the partial clip of tissues.

FIG. 4 is a drawing of the sample of FIG. 3, but with the number of tissue sheets in the clip 15 reduced to about 60. The weight of the tissue clip was 75 grams. The clip riser sheet 10 assumed an arched shape and lifted the clip about 1 inch.

Figure 5:
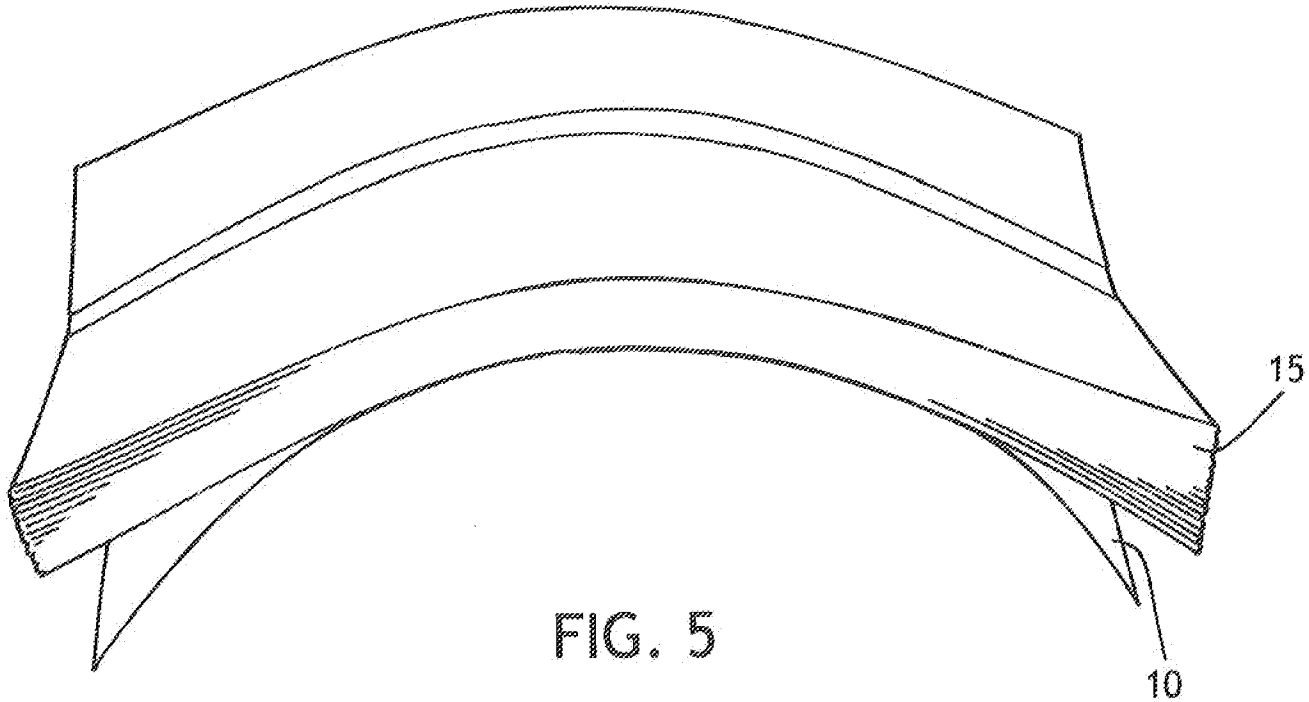
FIG. 5 is a drawing replicating a photograph of a partial clip of facial tissues, similar to that of FIG. 4, but with fewer tissues remaining in the clip, illustrating how the arch-shaped clip riser continues to recover towards its normal, unstressed state and thereby further raising the remaining tissues within the clip.

FIG. 5 is a drawing of the sample of FIGS. 3 and 4, but with the number of tissue sheets in the clip 15 further reduced to about 30. The weight of the clip was about 40 grams. As shown, the clip riser sheet 10 arched even further toward its unstressed shape. The clip was lifted about 1.5 inches.

Figure 6:
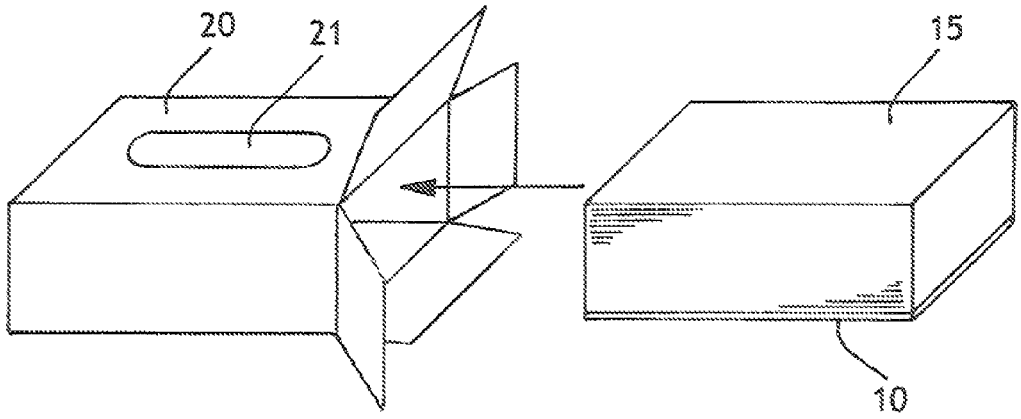
FIG. 6 is a schematic illustration of a method of making a tissue product in accordance with this invention, showing a clip of tissues, supported by a flattened arch-shaped clip riser, being inserted into an open tissue carton.

FIG. 6 is a schematic illustration of a method of making the products of this invention. As shown, a tissue clip 15 supported by a clip riser sheet 10, is inserted into an open tissue carton 20 having a dispensing opening 21 in the top of the carton. The clip riser sheet 10 can be "activated" (heat treated either thermally or by micro-waves) prior to being inserted into the carton or after being inserted into the carton. The manner and location at which the clip riser sheet is activated is a matter of preference based on the converting process and equipment being used to assemble the tissue products. In one embodiment, a roll of the bi-component sheet material is continuously unwound and combined with a moving tissue sausage (a continuous clip of interfolded tissues). The sausage/bi-component sheet material combination is conveyed to a saw station where the sausage is cut into clips as depicted in FIG. 6. Thereafter the individual clips are inserted into cartons in a conventional manner. While the combined sausage/clip lift sheet is moving toward the saw station, the clip lift sheet can be micro-waved to activate the tendency to bend. Since the weight of the clip will keep it flat, the overall process is unaffected.

Figure 7:
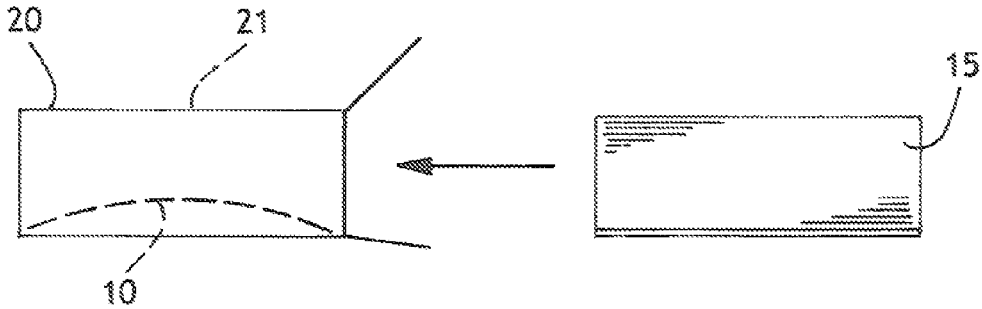
FIG. 7 is a schematic illustration of another method of making a tissue product in accordance with this invention, showing a clip of tissues being inserted into a carton containing the arch-shaped clip riser.

FIG. 7 is a schematic cross-sectional representation of a different method of making products of this invention, in which the clip riser sheet 10 is positioned inside the carton before the tissue clip is inserted. This is possible since the rigidity of the clip riser sheet is relatively low and the tissue clip can depress and flatten the clip riser sheet as the tissue clip enters the carton and slides over the clip riser.

Figure 8:
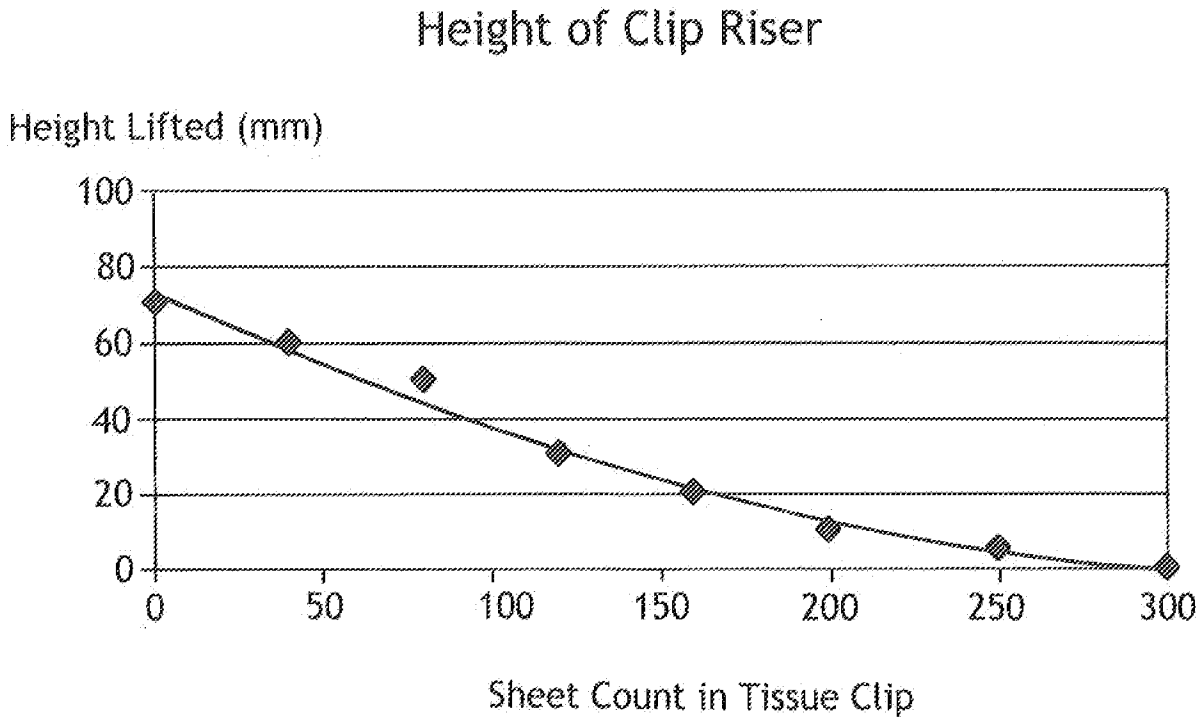
FIG. 8 is a plot of the height of an arch-shaped clip riser sheet in accordance with this invention as a function of the sheet count in the tissue clip.

FIG. 8 is a plot of the height of an arch-shaped clip riser sheet in accordance with this invention as a function of the sheet count in the tissue clip. The arch-shaped clip riser sheet was a bi-component sheet measuring 8 inches long and 4 inches wide. It consisted of a top layer component of a paper board material taken from a standard manila file folder (SMEAD Corp item number 2-152-5LA), having a thickness of about ½ millimeter. The bottom layer component was a polyvinyl chloride/polyvinyl acetate plastic film, commonly used for report covers (OXFORD Standard Grade Clear Front Report Cover, item number 55856, Esselte Corp (Pendaflex.com), also having a thickness of about ½ millimeter. The two components were glued together using Elmers Stix All glue by applying several smears of glue oriented mainly in the long direction. Upon activation by heating the bi-component sheet in an oven at 90 degrees C. for 60 seconds, the clip riser was slightly bent in a circular arched shape and allowed to cool. As it cooled, it bent further and the finished result was an arched-shaped clip riser sheet which bent about 3 inches in the vertical direction, which is believed to be a suitable amount of bending to sufficiently elevate the heaviest tissue clips of most tissue cartons. As shown, the arch-shaped clip riser sheet was substantially flat when loaded with a full clip of tissues. As the tissues were removed from the clip and the load decreased, the arch-shaped clip riser sheet lifted the clip. When all of the tissues were removed, the unstressed arch-shaped clip riser sheet formed an arch having a height of 75 millimeters.

It should be noted that any arch-shaped sheet with a memory and the proper degree of rigidity can be used as an arch-shaped clip riser for purposes of this invention. The heat activated bi-component sheet material described above is particularly suitable because it can be easily integrated with commercial tissue production methods in a flat sheet form as described above. Other arch-shaped clip risers can be formed by forming them in the desired shape and then flattening them afterwards, or by expanding one layer of the clip riser to cause the initial bending.

It will be appreciated that the foregoing description and example are not to be construed as limiting the scope of this invention, which is defined by the following claims and all equivalents thereto.

We claim:

1. A method of making a clip of tissues comprising:

(a) continuously combining a bi-component sheet material with a continuous clip of interfolded tissues having a topside and an underside, the bi-component sheet material having a top layer and a bottom layer, wherein the top layer is in contact with the underside of the continuous clip of tissues;

(b) cutting the continuous clip of tissues and the bi-component sheet material into individual clips, wherein the resulting individual clips of tissues are supported by a bi-component sheet; and (c) heating the bottom layer of the bi-component sheet; and (d) inserting the individual clip into a tissue carton, wherein upon dispensing of a tissue from the tissue carton the bi-component sheet forms an arch.

2. The method of claim 1 wherein the top layer of the bi-component sheet material is selected from the group consisting of paper, paper board, plastic and metal and the bottom layer comprises a material selected from the group consisting of plastic film, plastic sheeting and metal.

3. The method of claim 1 wherein the individual clips are from about 6 to about 12 inches in length.

4. The method of claim 1 wherein the individual clips are from about 1 to about 4 inches in width.

5. The method of claim 1 wherein the top and bottom layers of the bi-component material have a thickness from about 0.1 to about 3 millimeters.

6. The method of claim 1 wherein the top and bottom layers of the bi-component material have a thickness from about 0.25 to about 2 millimeters.

7. The method of claim 1 wherein the top and bottom layers of the bi-component material have a thickness from about 0.5 to about 1.5 millimeters.

8. The method of claim 1 wherein the top layer of the bi-component paper or paper board and the bottom layer is plastic.

* * * * *